US005775085A

United States Patent [19]

Baechler

[11] Patent Number: 5,775,085

[45] Date of Patent: Jul. 7, 1998

[54] METHOD AND DEVICE FOR PREVENTING MASS FLUCTUATIONS IN FIBER MATERIAL

[75] Inventor: François Baechler, Wermatswil, Switzerland

[73] Assignee: Zellweger Luwa AG, Wilstrasse, Switzerland

[21] Appl. No.: 683,405

[22] Filed: Jul. 18, 1996

[30] Foreign Application Priority Data

Jul. 19, 1995 [CH] Switzerland ..... 02127/95

[51] Int. Cl.[6] ..... D01H 4/00; D01H 7/46

[52] U.S. Cl. ..... 57/264; 57/405; 57/406; 57/408; 57/411; 57/412

[58] Field of Search ..... 57/264, 412, 405, 57/406, 408, 411

[56] References Cited

U.S. PATENT DOCUMENTS

| | | | |
|---|---|---|---|
| 3,698,174 | 10/1972 | Boucek et al. | 57/58.95 |
| 4,056,926 | 11/1977 | Stuber | 57/264 |
| 4,058,962 | 11/1977 | Spescha et al. | 57/34 R |
| 4,195,345 | 3/1980 | Artzt et al. | 57/264 |
| 4,228,642 | 10/1980 | Dakin et al. | 57/264 |
| 4,246,748 | 1/1981 | Artzt et al. | 57/264 |
| 4,271,565 | 6/1981 | Grunder | 19/240 |
| 4,379,386 | 4/1983 | Goldammer et al. | 57/405 |
| 4,742,675 | 5/1988 | Leifeld | 57/412 |
| 4,860,406 | 8/1989 | Stäheli et al. | 19/105 |
| 4,955,266 | 9/1990 | Stäheli et al. | 19/105 |

FOREIGN PATENT DOCUMENTS

| | | | |
|---|---|---|---|
| A-1814033 | 8/1969 | Germany . | |
| 2344600 | 9/1973 | Germany | 57/264 |
| 2944219 | 7/1980 | Germany | 57/264 |

*Primary Examiner*—William Stryjewski
*Attorney, Agent, or Firm*—Burns, Doane, Swecker & Mathis, L.L.P.

[57] ABSTRACT

The invention relates to a method and a device for preventing mass fluctuations in fiber material (1) which is processed in a spinning process using a rotor (10) to form a yarn (3). To this end, the mass fluctuations in the fiber material are detected in the immediate vicinity of the rotor and elements (6, 7, 12) which are drive-connected therewith, and are reduced by a control intervention.

5 Claims, 8 Drawing Sheets

METHOD AND DEVICE FOR PREVENTING MASS FLUCTUATIONS IN FIBER MATERIAL

FIELD OF THE INVENTION

The invention relates to rotor spinning and particularly to methods and apparatus for preventing mass fluctuations in rotor spun yarns.

BACKGROUND OF THE INVENTION

Known rotor spinning machines usually comprise a large number of spinning stations (so-called "spinning boxes") provided with a common drive for all the important fiber controlling elements. This means in particular that the feed roller, the separating roller, the rotor, the take-up roller and the splined cylinder at each spinning station are connected to a common drive and have fixed relative rotational speeds.

Consequently, the various rotational speeds can only be changed as a whole. For example, changes are made in order to influence the quantity of yarn produced. As a result of influences of this type, all spinning stations are usually monitored as a whole. However, each spinning station has its fibers supplied by an individual supply strand or sliver, herein referred to as a "fiber strip", the mass of which may vary along its lengthwise extent.

A disadvantage of rotor spinning machines of this type stems from irregularities in the mass of the supplied fiber strip. These can lead to irregularities in the spun yarn at the spinning station outlet. One can attempt to minimize the problem by ensuring that the supplied fiber strip is as regular as possible and exhibits no mass fluctuations over its length and cross section. However, this can only be achieved in situations where controlling the uniformity of the fiber strips used in the machines is actually possible from an organizational point of view. If the fiber strips to be used are bought for processing to form yarn, then this possibility does not exist.

SUMMARY OF THE INVENTION

It is therefore an object of the invention to provide a method and a device for preventing mass fluctuations in rotor spun yarn, by means of which the irregularities in mass which are present in the supplied fiber strips can be reduced as a part of the yarn production process. The invention enables the production by rotor spinning of yarn which is as uniform as possible.

This object is attained in that the mass fluctuations in the fiber material are detected in the rotor spinning machine in the immediate vicinity of the rotor and elements which are drive-connected therewith, and the effects of such fluctuations are reduced by a control intervention. The term "control intervention" is used herein to refer to the intervention of a control system acting in response to control signals to change the speed of a component that advances the yarn or fiber strip in a lengthwise direction. A control intervention of this type is used to control, as a function of measured mass fluctuations, either the supply of the fiber strip to the spinning rotor or withdrawal of yarn at the outlet of the spinning process. In this respect, the rotor is driven at a relatively constant operating velocity.

Control interventions of this type are achieved with the aid of a control circuit or a control process which directly influence the conversion of unspun fibers to yarn or the elements which participate in this process. This can occur by changing the relationship between the circumferential velocities of those elements drawing off fibers or yarn and those elements which supply fiber strip, in such a manner that the build up of fiber accumulations is avoided and thin areas are filled out. This is carried out in each case as a function of a measurement value.

A measurement value which detects thick or thin areas of this type can be transmitted, for example, by a strip measuring element which is arranged upstream of the feed roller, or by a yarn sensor arranged downstream of the rotor. In the first case, this results in an open control circuit. In the second case the result is a closed control circuit where the control intervention is effected at the feed roller, for example. However, combined control methods with open and closed control circuits are also possible. A control means of this type preferably operates with digitized signals and is divided into control modules and a central unit, a control module being associated with each spinning station and a central unit being associated with a plurality of spinning stations. In this case, the central unit manages, distributes and at the start transmits adjustment data or values, for example, which are compulsory for all spinning stations. The individual control modules operate exclusively for the associated spinning station and in response to control signals from the central unit.

As a result of the device according to the invention or the method according to the invention it is possible to compensate irregularities practically immediately before or during the conversion from fiber strip to yarn. Consequently, it can be assumed that fewer clearing interventions need to be carried out in respect of the yarn and that yarn with an improved and more uniform quality is obtained. On the other hand, it is also possible to process relatively poor, because irregular, fiber strips directly into good, regular yarn.

If it is intended to use this method and device especially for producing high-quality yarn, the fiber strip can first be evened out (for example by controlled drawing or stretching) and residual flaws in the yarn can then be improved by clearing to within narrow tolerances. Then it is possible to carry out the individual interventions into the material flux in the fiber strip, during spinning and during clearing with greater care or to specialize in particular flaw types or effects. A further advantage consists in that each spinning station of a spinning machine can now manufacture a separate yarn number, since a different control signal containing the values which are to be observed can be made available to each spinning station using a control system according to the invention.

BRIEF DESCRIPTION OF THE DRAWINGS

The invention is explained in further detail in the following with the aid of an example and with reference to the accompanying drawings, in which.

DETAILED DESCRIPTION OF PREFERRED EMBODIMENTS

Figure 1:
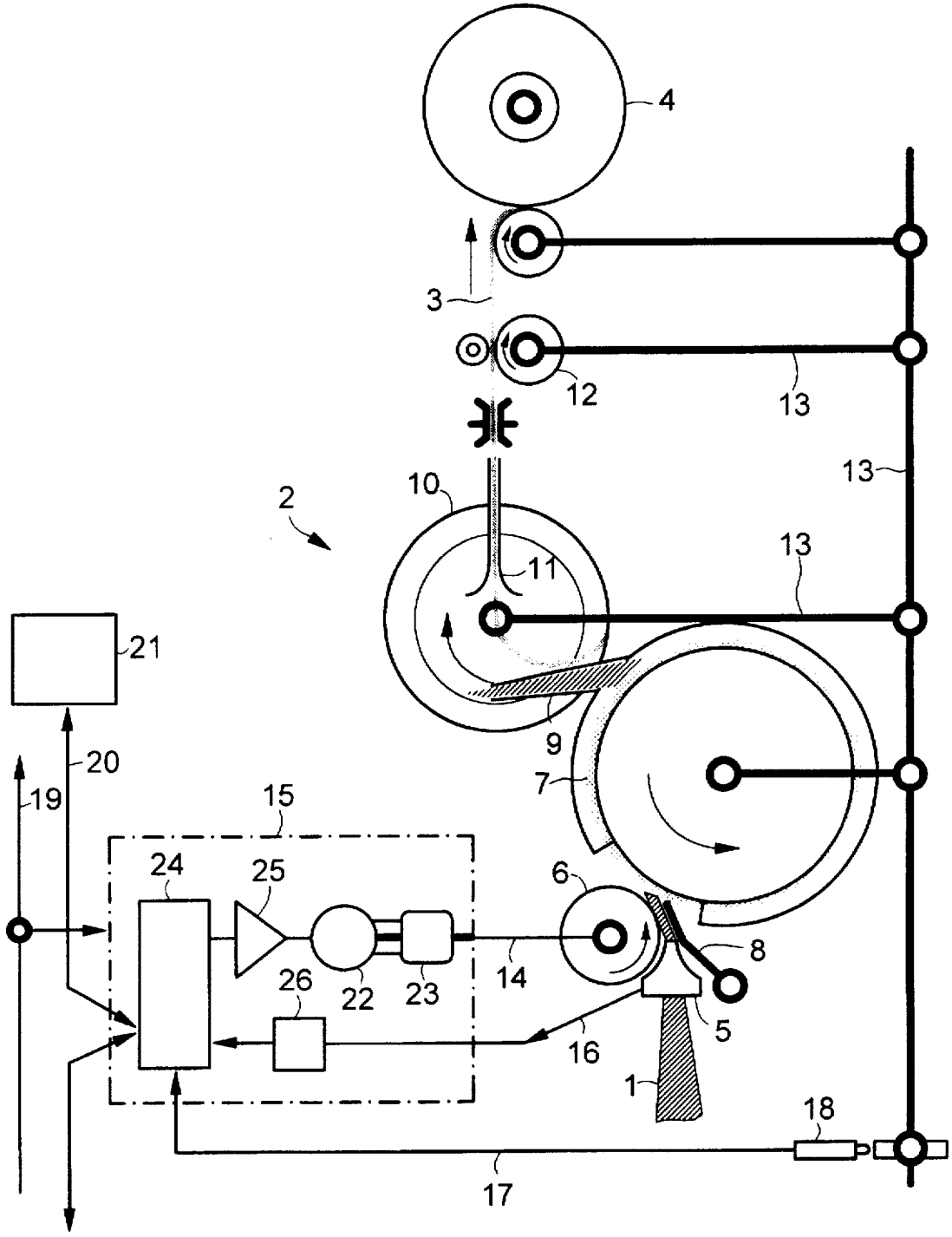
FIG. 1 is a schematic illustration of a spinning process and apparatus with the elements involved therein and a control device.

FIG. 1 shows a fiber material flow. The fiber strip 1 is first supplied to a spinning station 2, leaves the station as yarn 3, and is wound onto a yarn bobbin 4. In between, the fiber strip 1 is supplied via a strip compressor 5 to a feed roller 6 which acts with the aid of a feed trough 8 to advance the strip into a separating roller 7, where the fibers are separated from the sliver or strip 1 and received onto the periphery of the separating roller 7. A fiber suction element 9 draws the fibers from the separating roller 7 and conveys them into a rotor 10. A yarn forms on the rotor wall and is drawn off via a yarn funnel 11, being removed by a take-up roller 12 and supplied to the yarn bobbin 4.

The take-up roller 12, the rotor 10, and the separating roller 7 are driven via a drive line 13 and are rigidly connected to one another by the drive. The feed roller 6, the separating roller 7 and the take-up roller 12 are elements which can be drive-connected to the rotor and are arranged in the vicinity thereof, since they cooperate directly with the rotor 10. All these elements form a drive for the fiber material. The elements described so far are known per se and are found in the spinning station or spinning box of a rotor spinning machine.

In the first embodiment of the device according to the invention illustrated in FIG. 1, the feed roller 6 is connected via a drive line 14 to a control device 15. The control device 15 is also connected via lines 16, 17 to the strip compressor 5 (in this case either constructed as or provided with a strip measuring element) and to a pulse transmitter 18, which can derive from the drive line 13 pulses which are proportional to the speed thereof. A further line 19 is used for the supply, and a bus 20 is used as a connection with a central unit 21.

In this case, the control device 15 comprises a servomotor or control motor 22 and a gearing 23 for the drive line 14, as well as a computer or processor 24, an amplifier 25 and an evaluation unit 26 for processing signals for the control motor 22. The processor 24 is designed for transforming a physical value into an electrical signal. In conventional fashion, the processor 24 comprises analogue/digital and digital/analogue converters connected to inputs or outputs, and a microprocessor with a memory.

The method of operation of the device according to FIG. 1 is as follows: Mass fluctuations in the fiber material 1 are detected by the strip measuring element in the strip compressor 5 and converted into an electrical signal, which is supplied via the line 16 to the evaluation unit 26. Here, the current measurement value may, for example, be compared with threshold values which determine a tolerance range for measurement values which will not trigger a control process. Evaluated signals, preferably analogue signals, are supplied to the computer 24, where they are digitized, linearized, monitored according to predetermined standpoints, delayed and amplified. The computer 24 also has at its disposal a signal from the pulse transmitter 18, which indicates the current operating velocity of the other elements. On the basis of the input signals, i.e. the velocity and the momentary mass of the fiber strip, the computer 24 determines an output signal which it transmits to the amplifier 25, the signal representing a correction or control value indicating the desired new circumferential velocity for the feed roller 6. This correction value controls the rotational velocity of the control motor 22 and, via the gearing 23, also the rotational velocity of the feed roller 6. The control circuit illustrated in this case is therefore an open control circuit which is designed to produce uniform fiber loading of the separating roller 7. In this manner it can be assumed that a very uniform fiber flow reaches the rotor 10 via the fiber suction element 9.

Figure 2:
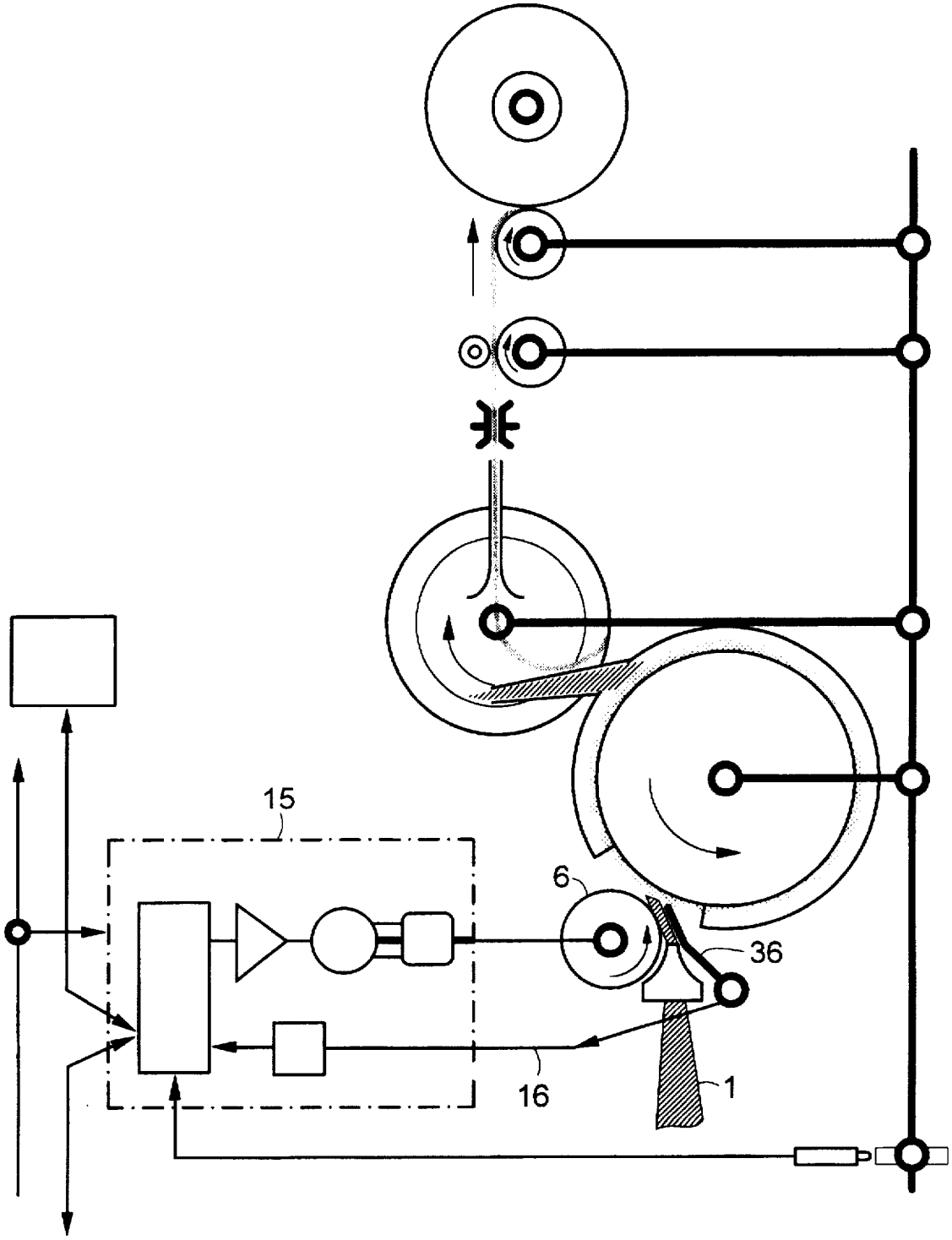
FIG. 2 is a schematic illustration similar to FIG. 1, but showing another embodiment of control apparatus according to the invention.

FIG. 2 shows a device which comprises essentially the same elements as the device in FIG. 1, but in which the line 16 is connected to a sliver sensing element 36 which replaces or supplements the feed trough of FIG. 1. The sensing element 36 is spring-loaded and presses the fiber strip 1 against the feed roller 6. The fiber strip 1 deflects the element 36 in proportion to the mass of fiber material 1 located, at the moment, between the adjacent surfaces of the roller 6 and the element 36. In effect, the element 36 traces the lengthwise mass profile of the moving fiber strip 1, and such elements will be referred to herein as "tracer elements." The deflection of the tracer element is converted into an electrical signal, and signal processing is effected in a now known manner in the control device 15.

Figure 3:
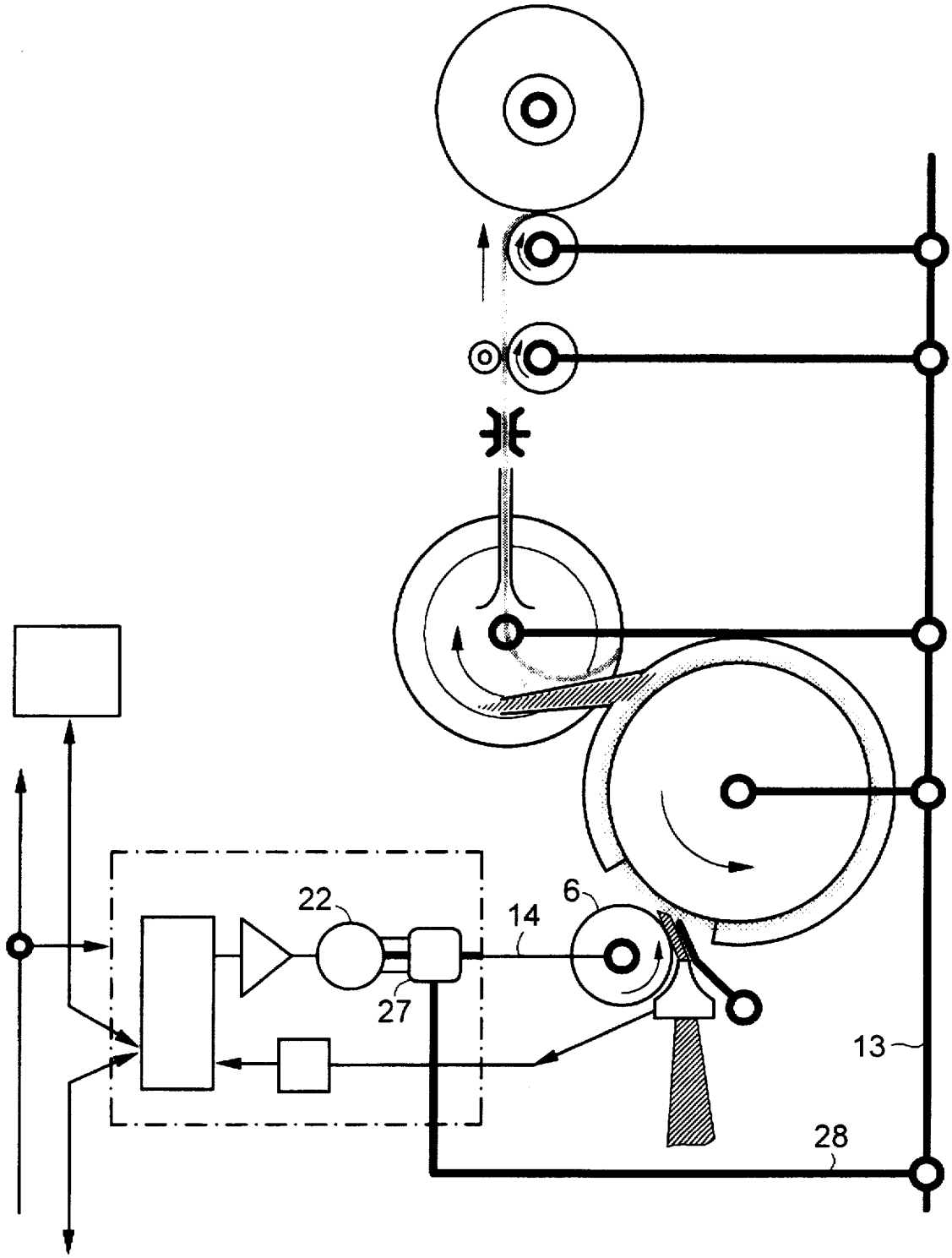
FIG. 3 is a schematic illustration similar to FIG. 1, but showing a further embodiment of control apparatus according to the invention.

In the embodiment of the invention according to FIG. 3, a differential or planetary gearing 27 is provided to control the speed of the feed roll 6. This is connected via a drive line 28 to the drive line 13, so that the servomotor 22 is only required to effect a rotational speed change in the drive line 14 for the feed roller 6. The mean rotational speed, from which this rotational speed change is derived, is supplied to the differential gearing 27 via the drive line 28. Consequently, there is no need for the pulse transmitter 18 of FIG. 1.

Figure 4:
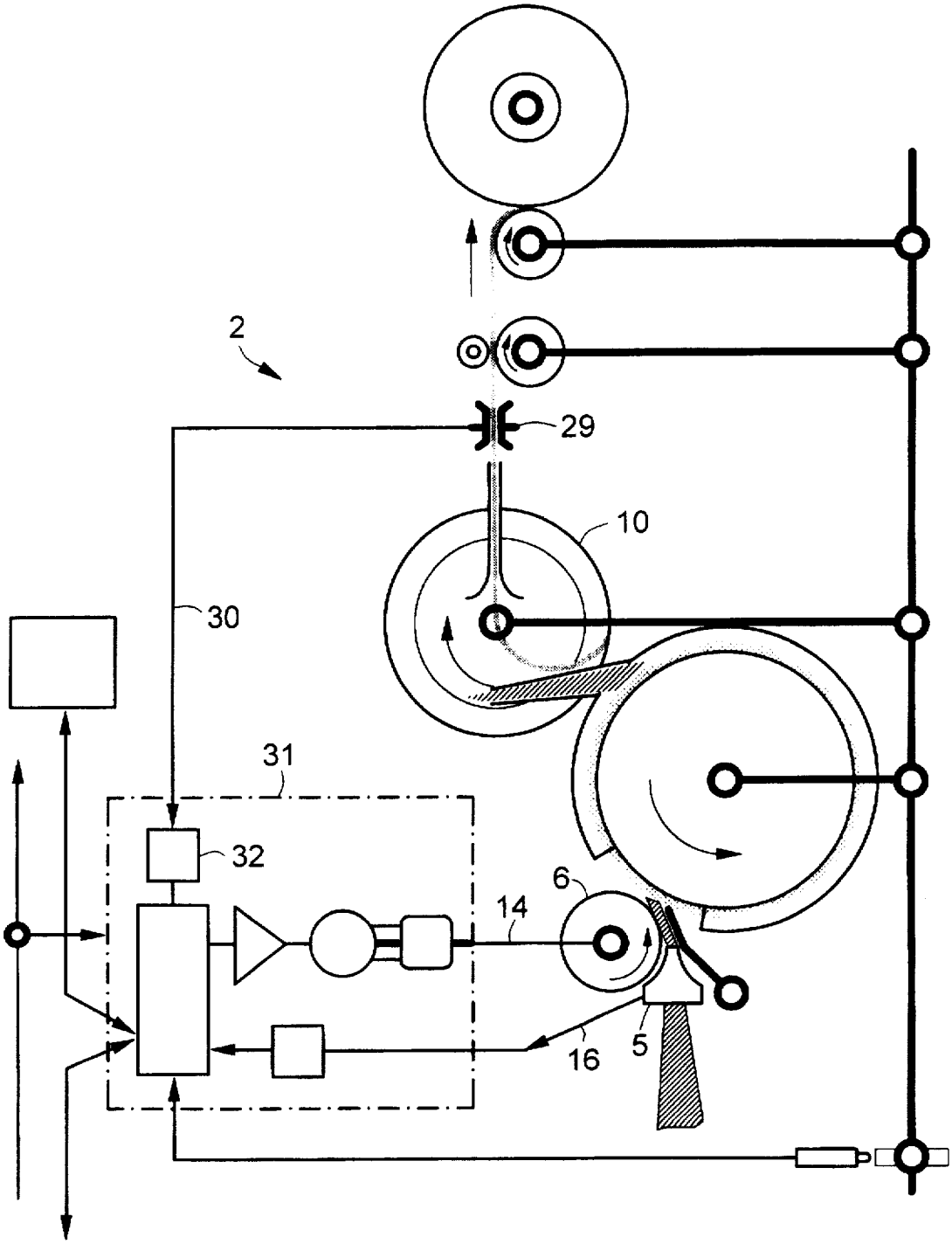
FIG. 4 is a schematic illustration similar to FIG. 1, but showing an additional embodiment of control apparatus according to the invention.

In the embodiment according to FIG. 4, an additional yarn measuring element 29 is arranged downstream of the rotor 10, toward the outlet of the spinning station 2. The yarn measuring element 29 can be arranged upstream (as illustrated in this case) or downstream of the take-up roller 12. The yarn measuring element 29 is a known element, which can scan the yarn optically or capacitively, for example. The yarn measuring element 29 is connected via a line 30 to an evaluation unit 32 in the control device 31. The evaluation unit 32 has the same function as the evaluation unit 26 in the control device 15 (FIG. 1). This design provides control behavior as is known for combined open and closed control circuits, for example for stretching machines, from EP 0176661 and the corresponding U.S. Pat. No. 4,653,153, the disclosure of which is incorporated herein in its entirety. The closed control circuit is formed in this case by the yarn measuring element 29, the line 30, the control device 31 and the drive line 14. The open control circuit is already known from FIGS. 1 to 3.

However, this embodiment can also operate in such a manner that the yarn measuring element 29 is used only to monitor the quality of the control process carried out by the open control circuit fitted between the strip compressor 5 and the feed roller 6. If the computer 24 determines that the quality of the yarn is poor by comparing predetermined yarn flaw tolerances stored therein with the signal from the strip measuring element 29, then it can cause the spinning station to close down or can cause a fault report or alarm signal to be transmitted. This can happen, for example, if the control circuit drifts, the measuring element is subjected to unusual vibrations, or if other disturbances occur.

Figure 5:
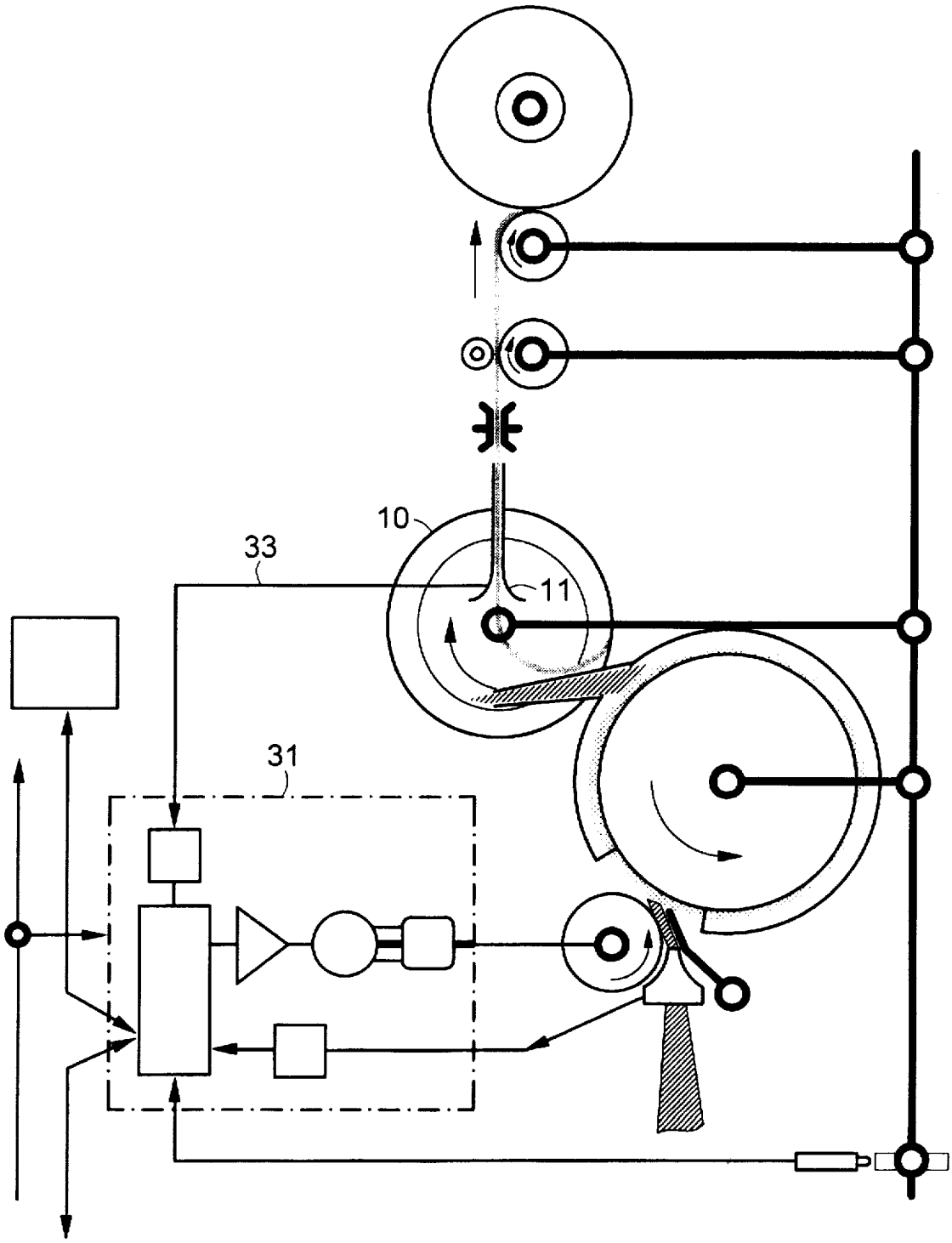
FIG. 5 is a schematic illustration similar to FIG. 1, but showing yet another embodiment of control apparatus according to the invention.

A further embodiment is shown in FIG. 5 in which the yarn funnel 11 at the output of the rotor 10 comprises a device for measuring the mass of the fiber material running through, the device transmitting a signal to the line 33. However, a measurement of this type can only take place downstream of the take-up roller 12. The processing of the signals in the control device 31 is effected in a manner previously described.

Figure 6:
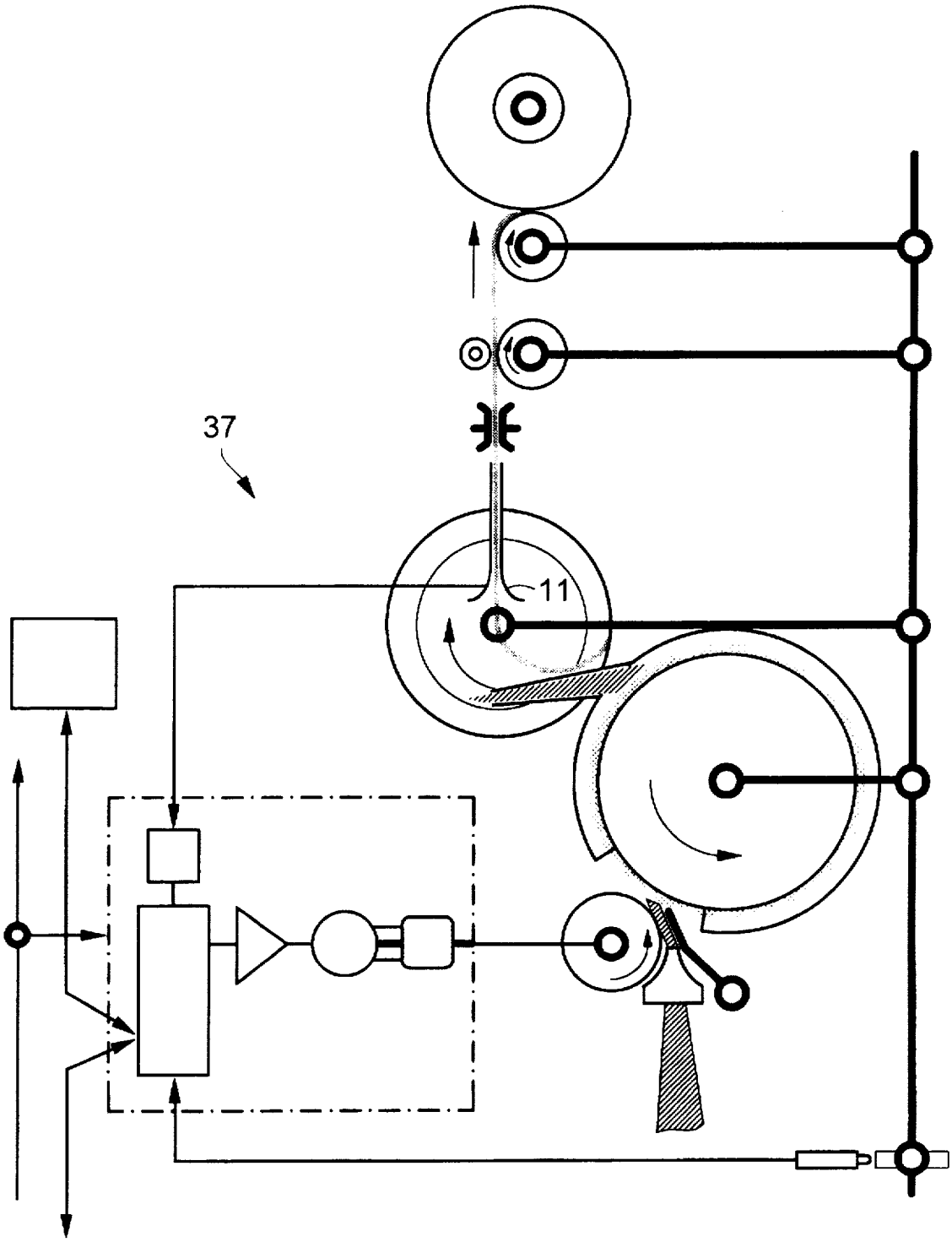
FIG. 6 is a schematic illustration similar to FIG. 1, but showing still another embodiment of control apparatus according to the invention.
Figure 7:
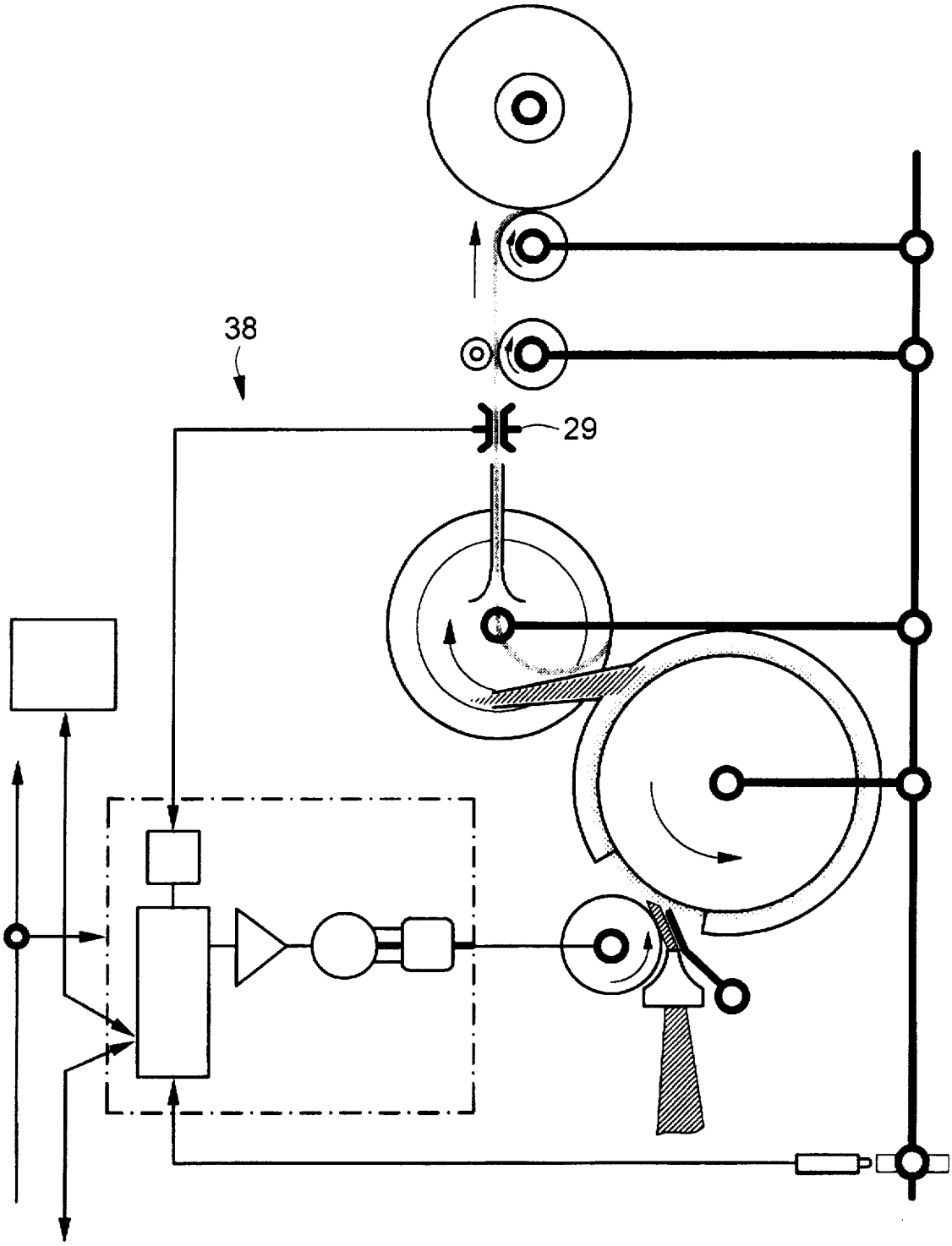
FIG. 7 is a schematic illustration similar to FIG. 1, but showing a still further embodiment of control apparatus according to the invention.

FIGS. 6 and 7 each show only a closed control circuit 37, 38 respectively, which in the embodiment according to FIG. 6 extends over the yarn funnel 11 and in the embodiment according to FIG. 7 over the independent yarn measuring element 29.

Figure 8:
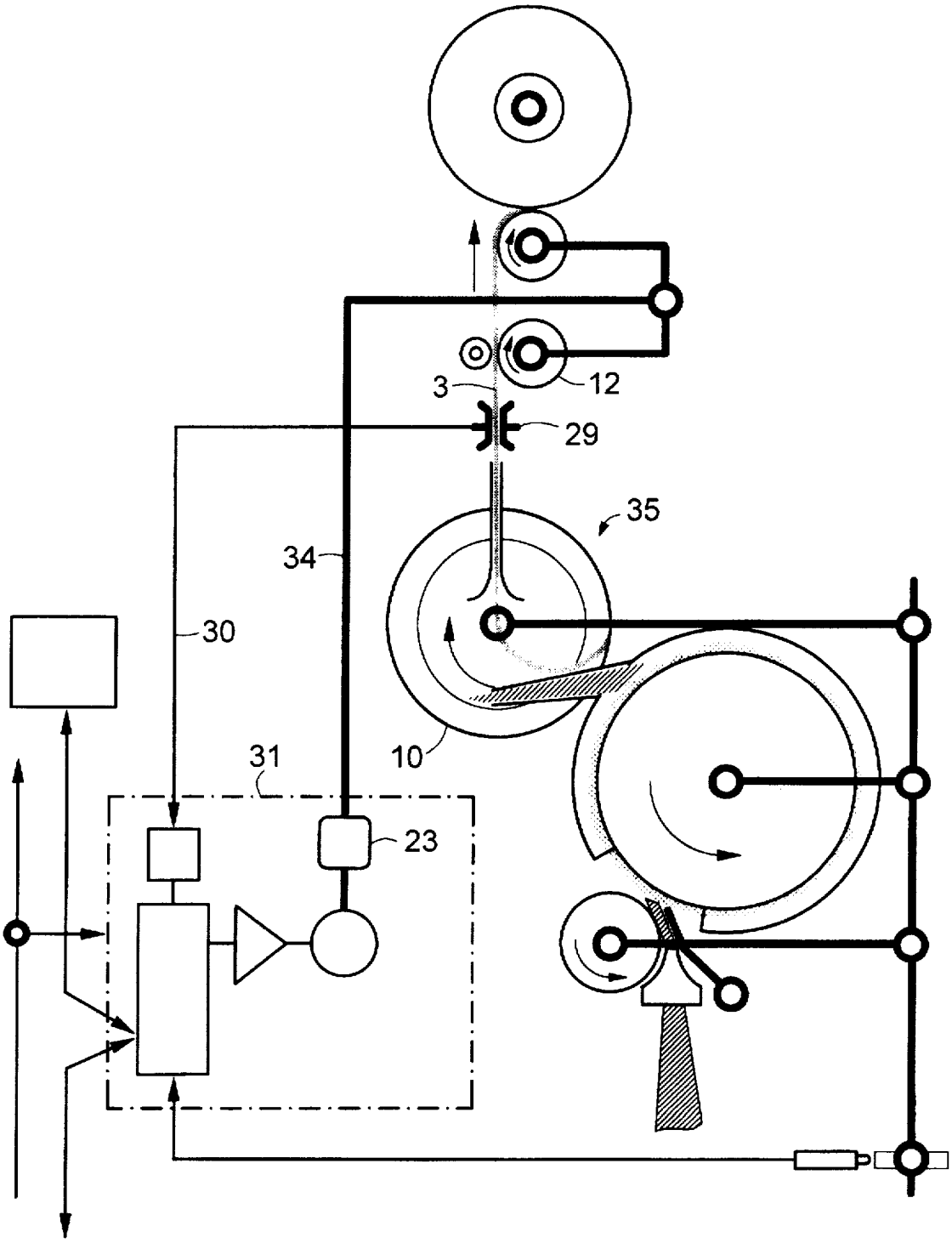
FIG. 8 is a schematic illustration similar to FIG. 1, but showing another additional embodiment of control apparatus according to the invention.

FIG. 8 shows an embodiment in which the take-up velocity of the take-up roller 12 is influenced by a control intervention. To this end, the take-up roller 12 is connected via a drive line 34 to the gearing 23. As soon as the yarn measuring element 29 detects a thin area, the take-up velocity is reduced. In the case of thick area being detected in the yarn 3, the velocity is increased. These processes mean that the yarn is taken up somewhat earlier or later than average from the rotor 10. Consequently, the site 35 at which the yarn is separated from the wall of the rotor 10 is also displaced. This embodiment is particularly suited for use in combination with a control circuit of the type described, for example, in FIG. 1. Instead of taking place in the yarn measuring element 29, the measurement forming the basis for control of the yarn take-up velocity can also be carried out at the supply trough 36.

What is claimed is:

1. A method for controlling mass fluctuations in yarn formed in a rotor spinning system of the type which includes a rotor, feed means for feeding fiber material toward the rotor, and take up means for withdrawing yarn from the rotor, said method comprising detecting fluctuations in the mass of fiber material being fed toward the rotor, detecting fluctuations in the mass of the yarn withdrawn from the rotor, and controlling the speed of at least one of said feed means and said take up means in response to detected mass fluctuations to reduce mass fluctuations in the yarn.

2. A method according to claim 1 wherein the speed of said feed means is controlled in response to both the detected fluctuations in the mass of the fiber material being fed toward the rotor and the detected fluctuation in the mass of the yarn withdrawn from the rotor.

3. A method according to claim 1 wherein the speed of said take up means is controlled.

4. A method for controlling mass fluctuations in yarn formed in a rotor spinning system of the type which includes a feed roll for advancing a strip of fiber material, a separating roller for separating fibers from the strip advanced by the feed roll, a spinning rotor for receiving fibers from the separating roller and forming them into a yarn, a take-up roll for removing the yarn from the rotor, means for driving said separating roller and said rotor and said take-up roll in fixed relationship to one another, and a control system; said method comprising providing to the control system a first input by detecting fluctuations in the mass of fiber material being processed; providing to the control system a second input by detecting fluctuations in the mass of the yarn removed from the rotor; providing to the control system a third input representing the operating velocities of the separating roller, the rotor and the take-up roll; operating the control system in response to said first, second, and third inputs to control the speed of said feed roll for reducing the mass fluctuations in the yarn being formed.

5. A rotor spinning system comprising a feed roll for advancing a strip of fiber material, a separating roller for separating fibers from the strip advanced by the feed roll, a spinning rotor for receiving fibers from the separating roller and forming them into a yarn, a take-up roll for withdrawing yarn from the rotor, means upstream of said rotor for detecting mass fluctuations in the strip of fiber material being advanced toward the rotor, means downstream of said rotor for detecting mass fluctuations in said yarn, and a control system operatively connected to both of said detecting means for regulating the speed of said feed roll in response to both fluctuations in the mass of the strip of fiber material and fluctuations in the mass of the yarn.

* * * * *